US005723833A

United States Patent [19]

Thrasher

[11] Patent Number: 5,723,833

[45] Date of Patent: Mar. 3, 1998

[54] ON-OFF SWITCH WITHIN A LOCKABLE HOUSING

[75] Inventor: Danny A. Thrasher, Anderson, S.C.

[73] Assignee: Ryobi North America, Inc., Easley, S.C.

[21] Appl. No.: 678,574

[22] Filed: Jul. 5, 1996

[51] Int. Cl.[6] ..... H01H 9/28

[52] U.S. Cl. ..... 200/50.12; 200/61.62

[58] Field of Search ..... 70/2, 4, 57, 158, 70/159; 200/43.01, 43.11, 43.16, 43.22, 50.01, 50.02, 50.09, 50.1, 50.11, 50.13, 50.14, 61.62, 61.7, 61.76, 293, 296, 297, 333, 334, 339, 50.12

[56] References Cited

U.S. PATENT DOCUMENTS

| | | | |
|---|---|---|---|
| 2,124,379 | 7/1938 | Stiles | 200/50 |
| 2,300,102 | 10/1942 | Christensen | 200/50 |
| 3,018,341 | 1/1962 | Bassani | 200/50 |
| 3,081,390 | 3/1963 | Lasar | 200/172 |
| 3,204,807 | 9/1965 | Ramsing | 220/24.3 |
| 3,233,071 | 2/1966 | Buzzell | 200/172 |
| 4,017,771 | 4/1977 | Baumann | 361/357 |
| 4,394,552 | 7/1983 | Schlosser | 200/61.62 |
| 4,506,120 | 3/1985 | Fleischman | 200/42 R |
| 4,713,509 | 12/1987 | Chebowski | 200/328 |
| 4,870,230 | 9/1989 | Osika et al. | 200/6 R |
| 5,041,706 | 8/1991 | Osika et al. | 200/296 |
| 5,045,648 | 9/1991 | Fogleman, Sr. | 200/43.16 |
| 5,047,598 | 9/1991 | Osika et al. | 200/43.16 |
| 5,095,181 | 3/1992 | Osika et al. | 200/43.16 |
| 5,260,209 | 11/1993 | Benda | 200/43.14 |
| 5,558,209 | 9/1996 | Mohsen | 200/43.22 |

*Primary Examiner*—Michael L. Gellner
*Assistant Examiner*—Michael A. Friedhofer
*Attorney, Agent, or Firm*—Brooks & Kushman PC

[57] ABSTRACT

An ON-OFF switch assembly which is lockable for preventing unauthorized use is disclosed. The ON-OFF switch assembly includes an ON-OFF electrical switch mounted within a housing. The ON-OFF electrical switch has an actuator which is shiftable between an ON position and an OFF position. A cover is pivotally attached over the housing between an opened position allowing access to the actuator, a closed position denying access to the actuator, and a run position where the cover is slightly open. The cover has a tab which shifts the actuator to the OFF position when the cover is pivoted to the closed position. A hasp is hinged to the housing. The hasp can be pivoted to extend through an aperture of the cover to enable locking the cover to the housing in the closed position using a padlock, and to retract from the housing to position the padlock clear of the housing to allow the cover to be freely pivoted.

8 Claims, 3 Drawing Sheets

ON-OFF SWITCH WITHIN A LOCKABLE HOUSING

TECHNICAL FIELD

The present invention relates generally to lockable switch housings with padlock hasps.

BACKGROUND ART

Many types of machines such as power tools and saws have ON-OFF switches used by an operator to turn the machine on and off. Frequently, it is desirable to protect the ON-OFF switch to prevent unauthorized use of the machine. Since ON-OFF switches are usually small in comparison with a machine operator's hand and because many operators wear gloves to protect their hands during machine operation, it is also desirable to provide an easily accessible and clearly noticeable means for the operator to turn the machine off without directly engaging the ON-OFF switch.

While many different types of machine switches have been designed with switch housings to prevent unauthorized actuation and to minimize the physical effort required to operate the switch, such switches and housings are relatively complex and expensive.

For instance, U.S. Pat. No. 4,731,509 issued to Chebowski discloses a palm switch actuator and guard therefor. However, unlike a simple switch cover designed to enclose a switch to restrict switch access, the palm switch actuator actuates the switch every time an operator presses it.

U.S. Pat. No. 3,204,807 issued to Ramsing discloses a hinged electrical cover plate closure designed to enclose a switch to restrict switch access. However, the cover plate closure is not capable of turning the switch on or off.

DISCLOSURE OF THE INVENTION

It is therefore an object of the present invention to provide an ON-OFF switch assembly which is lockable using a conventional padlock to prevent unauthorized use.

It is a further object of the present invention to provide an ON-OFF switch assembly having a cover which is capable of shifting an ON-OFF electrical switch to an off position.

In carrying out the above objects and other objects and features of the present invention, an ON-OFF switch assembly which is lockable using a conventional padlock is provided. The ON-OFF switch assembly includes a housing having an opening. An ON-OFF electrical switch is mounted within the housing. The ON-OFF electrical switch has an actuator which extends through the opening. The actuator is shiftable between an ON position and an OFF position.

A cover is pivotally attached to the housing. The cover is pivotable between an opened position where the actuator is accessible to an operator, a closed position where the cover encloses the actuator rendering the actuator unaccessible to the operator, and a run position where the cover is slightly open. The cover has a back surface with a tab extending therefrom. The tab engages the actuator to shift the actuator to the OFF position when the cover is pivoted from the run position to the closed position.

A hasp is pivotally attached to the housing. The hasp is pivotable between an extended orientation in which the hasp projects through an aperture in the cover to enable locking the cover in the closed position using a conventional padlock, and a retracted orientation in which the hasp with the conventional padlock is positioned sufficiently clear of the housing to allow the cover to be freely pivoted to the closed position.

The advantages accruing to the present invention are numerous. For example, the cover provides an easily accessible and readily identifiable means for an operator to turn a machine off. The cover can be locked to the housing to eliminate unauthorized use of the ON-OFF electrical switch. The hasp can hold the padlock clear of the housing to allow the cover to be pivoted to the closed position in one movement during machine operation.

The above objects and other objects, features and advantages of the present invention will be readily appreciated by one of ordinary skill in the art from the following detailed description of the best modes for carrying out the invention when taken in connection with the accompanying drawings.

BEST MODE FOR CARRYING OUT THE INVENTION

Figure 1:
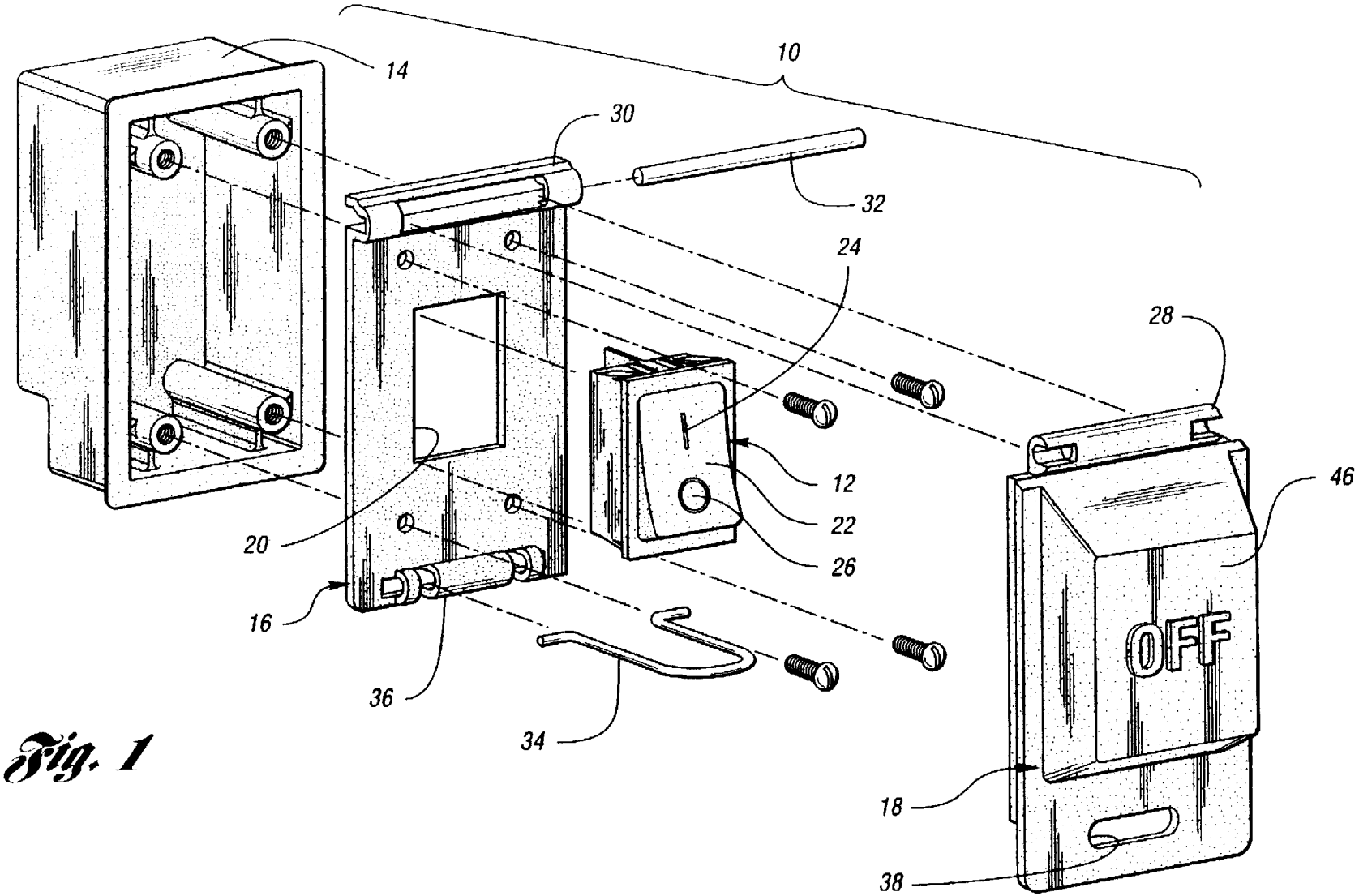
FIG. 1 is an exploded view of an ON-OFF switch assembly according to a preferred embodiment of the present invention.

An exploded view of an ON-OFF switch assembly 10 according to a preferred embodiment of the present invention is shown in FIG. 1. ON-OFF switch assembly 10 includes an ON-OFF electrical switch 12, a receptacle 14, a face plate 16, and a cover 18. ON-OFF electrical switch 12 is mounted within an opening 20 of face plate 16. ON-OFF electrical switch 12 has a rocker type actuator 22 which extends through opening 20 towards cover 18. Actuator 22 is shiftable between an ON position 24 and an OFF position 26.

Cover 18 is pivotally attached adjacent one edge 28 to a top edge 30 of face plate 16 by a hinge pin 32. Cover 18 is pivotally movable over actuator 22 and face plate 16 to allow and restrict access to actuator 22. As will be described below in further detail, cover 18 is pivotal between an opened position where actuator 22 is accessible to an operator, a closed position where actuator 22 is unaccessible to the operator, and a run position where cover 18 is slightly open.

ON-OFF switch assembly 10 further includes a hasp 34. Hasp 34 is pivotally attached to a bottom edge 36 of face plate 16. Preferably, hasp 34 has a U-shaped wire form. Hasp 34 can pivot about bottom edge 36 to extend through an aperture 38 of cover 18 to enable locking cover 18 to face plate 16.

Face plate 16 is fastened over receptacle 14 with fasteners such as screws of the like to make a housing for ON-OFF electrical switch 12. Receptacle 14 provides a protective cavity to house electrical wires connected between ON-OFF electrical switch 12 and a machine panel (P) shown in FIGS. 2–5. Of course, receptacle 14 can be mounted to a wall in a fashion similar to conventional switch boxes when ON-OFF switch assembly 10 is used for commercial and residential electric power lines. Preferably, receptacle 14 and face plate 16 are constructed from plastic.

In the preferred embodiment shown in FIG. 1, ON-OFF electrical switch 12 is a rocker switch. As commonly known, rocker switch 12 is shifted to a desired position from another position by pressing down on the desired position with sufficient force. For instance, an operator will press down on OFF position 26 to shift rocker switch 12 from ON position 24 to OFF position 26.

Figure 2:
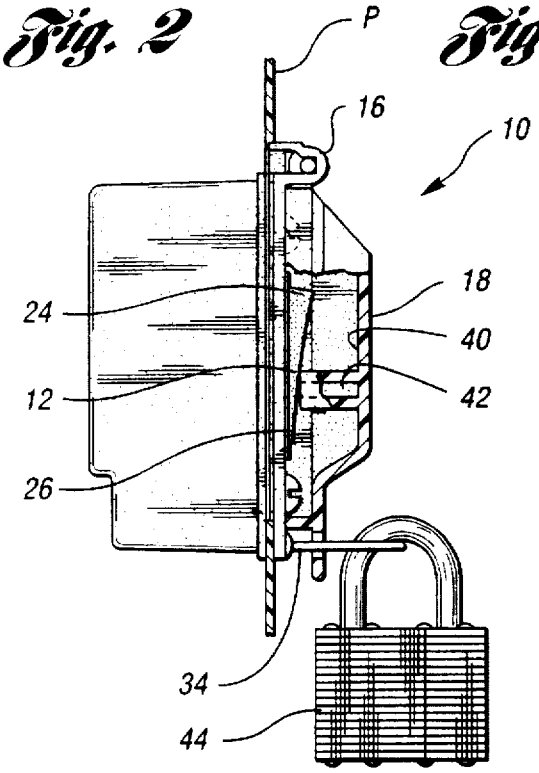
FIG. 2 is a side view of the ON-OFF switch assembly locked in a closed position with a padlock.

Referring now to FIG. 2, a feature of the present invention is that cover 18 is designed to shift rocker switch 12 to OFF position 26 when cover 18 is closed. Specifically, cover 18 has a back surface 40 with a tab 42 extending therefrom. Tab 42 is a post, lug, or the like. Tab 42 engages rocker actuator 22 of switch 12 to shift it from ON position 24 to OFF position 26 when cover 18 is pressed down with sufficient force.

Cover 18 is shown in FIG. 2 in the closed position over rocker switch 12. In this position, cover 18 encloses rocker switch 12 to render it unaccessible to an operator.

Figure 3:
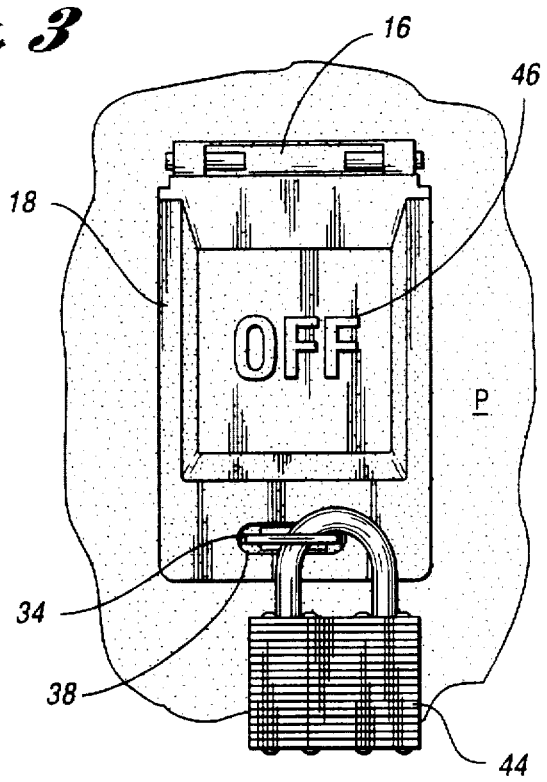
FIG. 3 is a frontal view of the ON-OFF switch assembly shown in FIG. 2.

Referring now to FIGS. 2 and 3, hasp 34 is shown in an extended orientation in which hasp 34 extends through aperture 38 in cover 18. Unauthorized access to rocker switch 12 can be prevented by snapping a conventional padlock 44 on hasp 34 when hasp 34 is extending through aperture 38 to lock cover 18 to face plate 16 in the closed position. Furthermore, while cover 18 is either locked or unlocked in the closed position, tab 42 maintains rocker switch 12 in OFF position 26.

Figure 4:
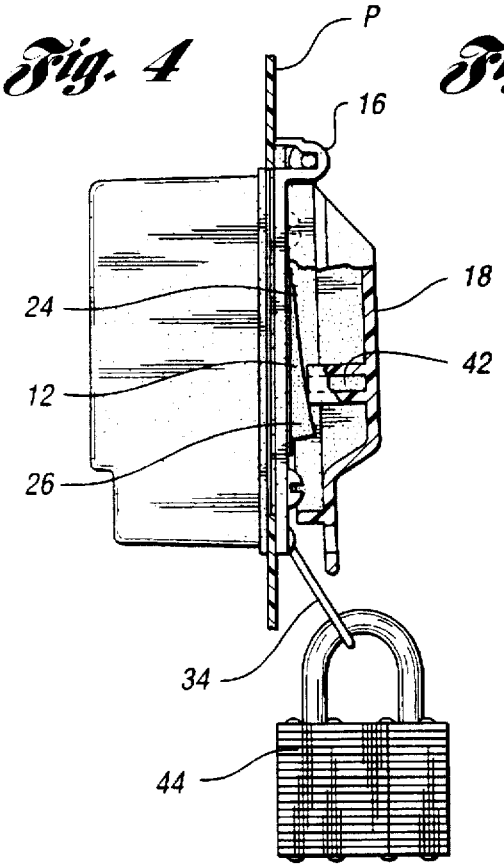
FIG. 4 is a side view of the ON-OFF switch assembly in a run position.

Referring now to FIG. 4, cover 18 is shown in the run position in which it is slightly open over rocker switch 12. An operator may access rocker switch 12 by pivoting cover 18 from the run position to the opened position. While cover 18 is in the opened position, the operator may manipulate rocker switch 12 as frequently as desired.

Although tab 42 is in contact with rocker switch 12 while cover 18 is in the run position, tab 42 will not shift rocker switch 12 from ON position 24 to OFF position 26 without the operator pressing down on cover 18 with sufficient force. Once the operator presses down on cover 18 with sufficient force, cover 18 will be pivoted to the closed position from the run position and tab 42 will engage rocker switch 12 to automatically shift it to OFF position 26. Subsequently, the only way rocker switch 12 can be shifted to ON position 24 is by the operator pivoting cover 18 to the opened position and then manually shifting rocker switch 12 to ON position 24.

Of course, the operator may manually shift rocker switch 12 to OFF position 26 when cover 18 is in the opened position. In this case, tab 42 will just maintain rocker switch 12 in OFF position 26 when cover 18 is pivoted to the closed position.

Figure 5:
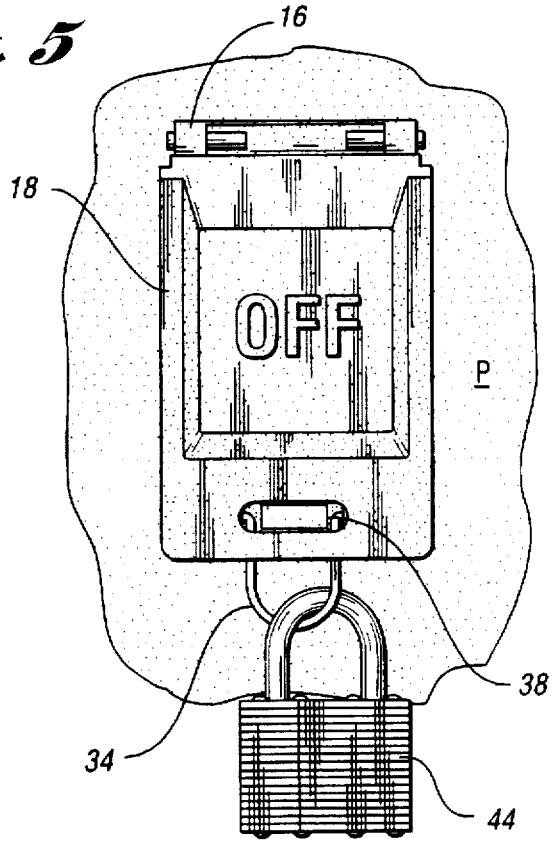
FIG. 5 is a frontal view of the ON-OFF switch assembly shown in FIG. 4.

Referring now to FIGS. 4 and 5, hasp 34 is shown in a retracted orientation in which hasp 34 projects through aperture 38 in cover 18. Once cover 18 is in the opened position, hasp 34 is pivotable from the extended orientation to the retracted orientation to position padlock 44 sufficiently clear of face plate 16 to allow cover 18 to be freely pivoted to the closed position. While positioning padlock 44 out of the trajectory of cover 18, hasp 34 provides a means to hold on to padlock 44 to prevent it from being lost or misplaced while the ON-OFF switch assembly 10 is in the run orientation.

Figure 6:
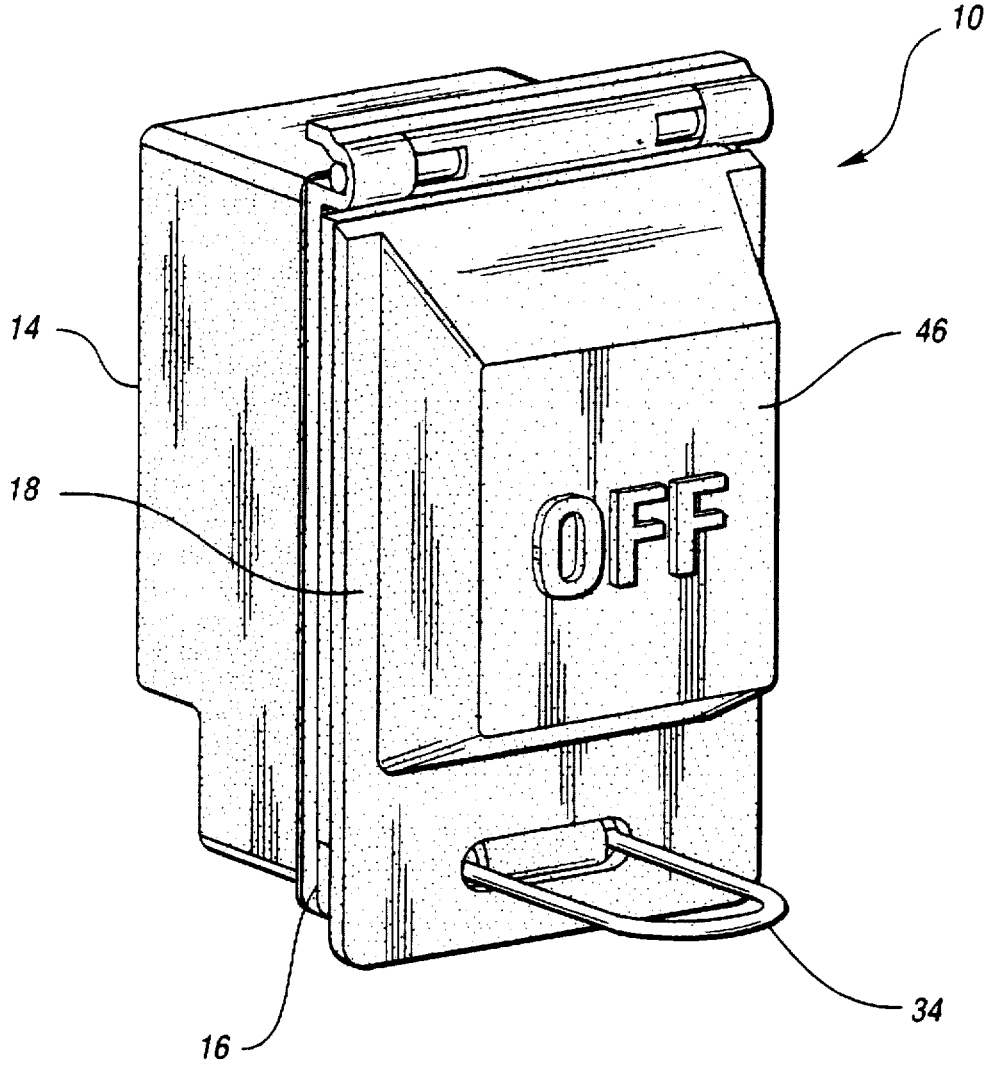
FIG. 6 is a perspective view of the ON-OFF switch assembly.

A perspective view of ON-OFF switch assembly 10 is shown in FIG. 6. Cover 18 may be provided with indicia on a front surface 46 visible to the operator such as the word "OFF" to facilitate quick shut off of the machine by the operator.

It is to be understood, of course, that while the forms of the present invention described above constitute the preferred embodiments of the present invention, the preceding description is not intended to illustrate all possible forms thereof. It is also to be understood that the words used are words of description, rather than limitation, and that various changes may be made without departing from the spirit and scope of the present invention, which should be construed according to the following claims.

What is claimed is:

1. An ON-OFF switch assembly which is lockable using a conventional padlock, the ON-OFF switch assembly comprising:

a housing having an opening;

an ON-OFF electrical switch mounted within the housing, the ON-OFF electrical switch having an actuator extending through the opening, the actuator being shiftable between an ON position and an OFF position;

a cover pivotally attached to the housing, the cover being pivotable between an opened position where the actuator is accessible to an operator, a closed position where the cover encloses the actuator rendering the actuator unaccessible to the operator, and a run position where the cover is slightly open, the cover having a back surface with a tab extending therefrom which engages the actuator to shift the actuator to the OFF position when the cover is pivoted from the run position to the closed position; and a hasp pivotally attached to the housing, the hasp being pivotable between an extended orientation in which the hasp projects through an aperture in the cover to enable locking of the cover to the housing in the closed position using the conventional padlock, and a retracted orientation in which the hasp with the conventional padlock locked thereon is positioned sufficiently clear of the housing to allow the cover to be freely pivoted to the closed position.

2. The ON-OFF switch assembly of claim 1 wherein the ON-OFF electrical switch is a rocker switch.

3. The ON-OFF switch assembly of claim 1 wherein the tab maintains the actuator in the OFF position while the cover is in the closed position.

4. The ON-OFF switch assembly of claim 1 wherein the hasp is a U-shaped wire form.

5. The ON-OFF switch assembly of claim 1 wherein the housing is constructed of plastic.

6. The ON-OFF switch assembly of claim 1 wherein the housing comprises a face plate having an opening and a receptacle, the face plate being attached over the receptacle.

7. The ON-OFF switch assembly of claim 1 wherein the cover has a front surface with indicia visible to the operator.

8. A rocker switch assembly which is lockable using a conventional padlock, the rocker switch assembly comprising:

a housing having an opening;

a rocker switch mounted within the housing, the rocker switch extending through the opening and being shiftable between an ON position and an OFF position;

a cover pivotally attached to the housing, the cover being pivotable between an opened position where the rocker switch is accessible to an operator, a closed position where the cover encloses the rocker switch rendering the rocker switch unaccessible to the operator, and a run position where the cover is slightly open, the cover having a back surface with a tab extending therefrom which engages the rocker switch to shift the rocker switch to the OFF position when the cover is pivoted from the run position to the closed position; and a hasp pivotally attached to the housing, the hasp being pivotable between an extended orientation in which the hasp projects through an aperture in the cover to enable locking of the cover to the housing in the closed position using the conventional padlock, and a retracted orientation in which the hasp with the conventional padlock locked thereon is positioned sufficiently clear of the housing to allow the cover to be pivoted to the closed position.

* * * * *